US008328030B2

(12) United States Patent
Kontetzki

(10) Patent No.: US 8,328,030 B2
(45) Date of Patent: Dec. 11, 2012

(54) LINKAGE FOR THE ARTICULATED CONNECTION OF A COUPLING ROD TO A RAILCAR BODY

(75) Inventor: Arthur Kontetzki, Salzgitter (DE)

(73) Assignee: Voith Patent GmbH, Heidenheim (DE)

( * ) Notice: Subject to any disclaimer, the term of this patent is extended or adjusted under 35 U.S.C. 154(b) by 332 days.

(21) Appl. No.: 12/656,982

(22) Filed: Feb. 22, 2010

(65) Prior Publication Data

US 2010/0270253 A1 Oct. 28, 2010

(30) Foreign Application Priority Data

Apr. 23, 2009 (EP) ..... 09158552

(51) Int. Cl.
*B61G 5/02* (2006.01)

(52) U.S. Cl. ..... 213/4; 213/45; 213/46 R; 213/46 A; 213/185

(58) Field of Classification Search ..... 267/3, 219, 267/196, 279; 213/185, 182, 7, 12, 13, 14, 213/40 R, 44, 45, 46 R, 64, 46 A
See application file for complete search history.

(56) References Cited

U.S. PATENT DOCUMENTS 606,105 A * 6/1898 Van Dorn ..... 213/12
3,859,821 A 1/1975 Wallace
4,136,787 A * 1/1979 Forster et al. ..... 213/40 R
5,351,844 A * 10/1994 Carlstedt ..... 213/44
6,315,139 B1 * 11/2001 Kreher ..... 213/9
7,624,884 B2 * 12/2009 Palermo et al. ..... 213/22
7,837,047 B2 * 11/2010 Krause ..... 213/64
2009/0039044 A1 * 2/2009 Krause ..... 213/64
2010/0270253 A1 * 10/2010 Kontetzki ..... 213/185

FOREIGN PATENT DOCUMENTS

EP 1342637 A1 9/2003
EP 1785329 5/2007
RU 2154581 C1 8/2000
SU 695852 A 11/1979

* cited by examiner

*Primary Examiner* — Jason C Smith
(74) *Attorney, Agent, or Firm* — Jean C. Edwards, Esq.; Edwards Neils PLLC

(57) ABSTRACT

The invention relates to a linkage for the articulated connection of a coupling rod to a railcar body, wherein the linkage includes a base plate connectable to the railcar body in which a through-hole is configured through which a railcar body-side end section of the coupling rod extends and a drawgear arranged on the railcar body-side end section of the coupling rod. The drawgear has a front spring plate affixed to the coupling rod in front of the base plate in the longitudinal direction of the coupling rod and a rear spring plate affixed to the coupling rod behind the base plate in the longitudinal direction of the coupling rod. To achieve effective anti-rotation protection, the front spring element and/or rear spring element engages with the base plate such that the rotational forces transmitted from the coupling rod to the base plate is conducted at a right angle without slip.

15 Claims, 5 Drawing Sheets

LINKAGE FOR THE ARTICULATED CONNECTION OF A COUPLING ROD TO A RAILCAR BODY

CROSS-REFERENCE TO RELATED APPLICATIONS

The present application claims priority from European Patent Application No. 09158552.1, filed Apr. 23, 2009, the contents of which are herein incorporated by reference in their entirety.

The present invention relates to a linkage for the articulated connection of a coupling rod to a railcar body, wherein the linkage comprises a base plate connectable to the railcar body in which a through-hole is configured through which the railcar body-side end section of the coupling rod extends, and wherein the linkage further comprises a drawgear arranged on the railcar body-side end section of the coupling rod which has a front spring plate affixed to the coupling rod in front of the base plate in the coupling rod's longitudinal direction and a rear spring plate affixed to the coupling rod behind the base plate in the coupling rod's longitudinal direction, wherein the drawgear comprises at least one front spring element made from an elastic material arranged between the base plate and the front spring plate and at least one rear spring element made from an elastic material arranged between the base plate and the rear spring plate.

This type of linkage for the articulated connection of a coupling rod to a railcar body is known, for example in rail vehicle technology, and is normally employed in this field in couplings and joints designed to interconnect railcars and/or entire trains using automatic couplings, respectively close couplings.

Figure 1A:
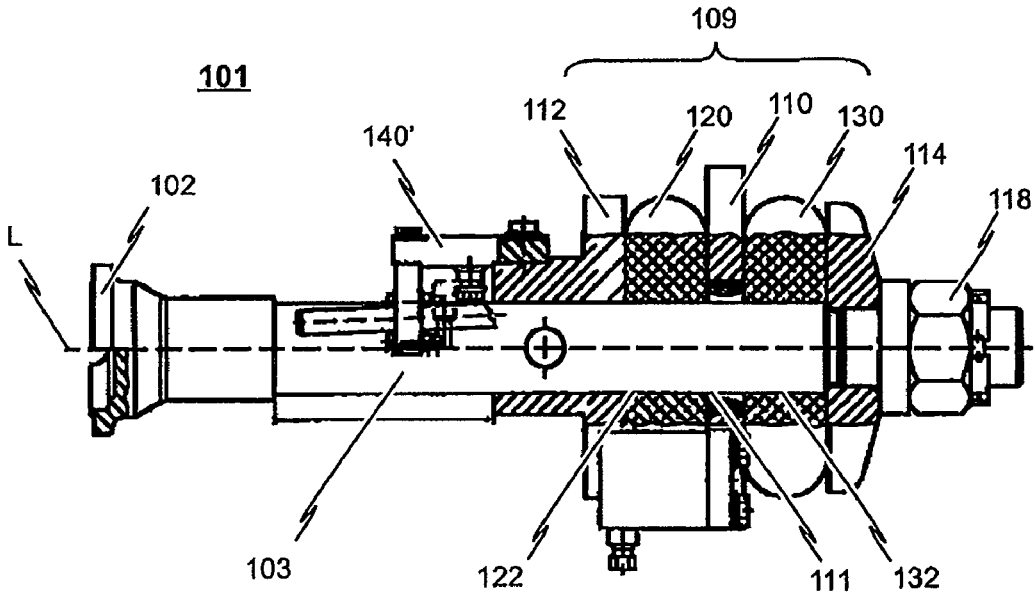
Fig. 1a PRIOR ART
Figure 1B:
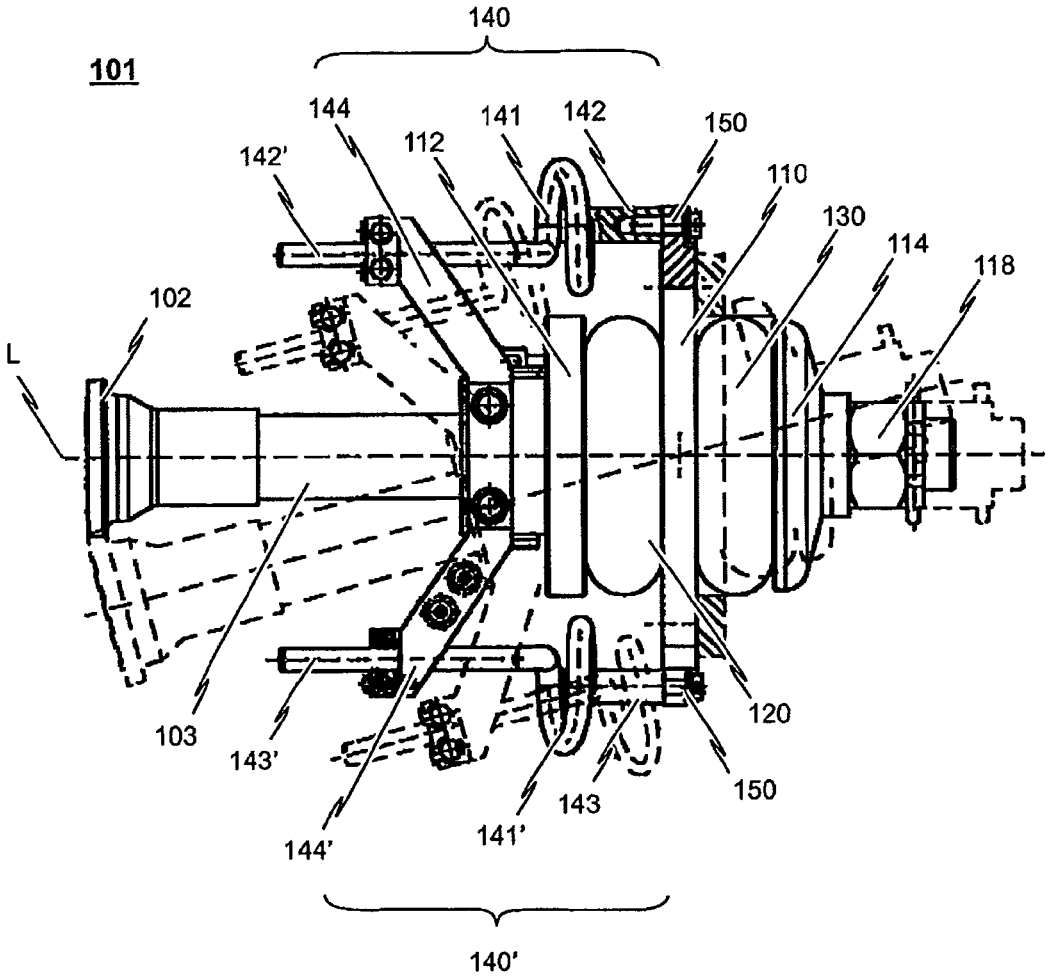
Fig. 1b PRIOR ART

To explain the fundamental structure of this type of linkage, reference is made to the depictions provided in FIGS. 1*a* and 1*b*, which show in a side view and a top plan view, a known prior art linkage of the type indicated above. Specifically, FIGS. 1*a* and 1*b* each show the linkage in a state in which no compressive or tractive forces are acting on the coupling rod.

As depicted, the conventional linkage 101 comprises a base plate 110 connectable to a (not shown) railcar body in which a through-hole 111 is configured. The through-hole 111 receives the railcar body-side end section 103 of a coupling rod 102 such that the railcar body-side end section 103 of the coupling rod 102 extends through the through-hole 111. A drawgear 109 is further arranged at the railcar body-side end section 103 of the coupling rod 102 which has a front spring plate 112 affixed to the coupling rod 102 in front of the base plate 110 in the coupling rod's longitudinal direction L as well as a rear spring plate 114 affixed to the coupling rod 102 behind the base plate 110 in the coupling rod's longitudinal direction L.

One spring element 120, 130 each in the form of an annular rubber spring is arranged between the base plate 110 and the front spring plate 112 as well as between the base plate 110 and the rear spring plate 114 such that the railcar body-side end section 103 of the coupling rod 102 extends through openings 122, 132 configured in the spring elements 120, 130 axially to the through-hole 111 configured in base plate 110. Specifically, the two spring elements 120, 130 are slid onto the railcar body-side end section 103 of the coupling rod 102 and braced by the front and rear spring plates 112, 114 and by a locknut 118.

In a pressurized state in which compressive forces are acting on the coupling rod 102, and thus on the railcar body-side end section 103 of the coupling rod 102, the coupling rod 102, respectively the railcar body-side end section 103 of the coupling rod 102 with the coupling rod-side front spring plate 112, is displaced in the direction of the car body so that the distance between the front spring plate 112 and the base plate 110 connected to the car body is reduced compared to the unloaded state as shown for example in FIGS. 1*a* and 1*b*. The front elastomer spring element 120 arranged between the front spring plate 112 and the base plate 110 is compressed as a consequence of the impacting compressive forces such that the compressive forces are conducted in a dampened manner via the compressed front spring element 120 to the base plate 110 and the (not shown) railcar body.

On the other hand, in a tensioned state, thus in which tractive forces are acting on the coupling rod 102, and thus on the railcar body-side end section 103 of the coupling rod, the rear spring plate 114 is displaced toward the base plate 110 relative said base plate 110 such that the rear spring element 130 is compressed and the tractive forces are conducted in dampened form via the compressed rear spring element 130 to the base plate 110 and the (not shown) railcar body.

Generally speaking, hollow springs made of an elastomer material are employed as spring elements 120, 130 in the drawgear 109 of the linkage 101 known from the prior art and depicted as an example in FIGS. 1*a* and 1*b*, whereby the design-contingent cross-sectional shape of said hollow springs is usually circular. In drawgear 109, the spring elements 120, 130 assume the function of damping the tractive and compressive forces occurring when force is trans-mitted from the coupling rod 102 to the car body. A further function of spring elements 120, 130 is the dissipating of some of the energy ensuing from the transfer of force.

Linkages for the articulated connection of a coupling rod to a railcar body need to be designed so as to allow the horizontal and vertical pivoting of the coupling rod relative the base plate connected to the railcar body which occur during operation so as to enable riding over rises and through dips as well as being able to corner through curves. To this end it is known to use a ball bush arrangement, for example, to guide the railcar body-side end section of the coupling rod through the through-hole provided in the base plate. The spring elements of the drawgear accommodate the horizontal and vertical pivoting of the coupling rod relative the base plate. It is also desired for the coupling rod to be able to rotate to a certain degree relative the base plate.

Yet in principle it also needs to be ensured that a coupling rod which has been rotated and/or pivoted horizontally or vertically can be returned again to its initial position. To enable such a resetting, the conventional linkage 101 depicted in FIGS. 1*a* and 1*b* makes use of a resetting and anti-rotation means. The resetting and anti-rotation means comprises two reset arms 140, 140' arranged in a horizontal plane to the respective left and the right of the railcar body-side end section 103 of the coupling rod 102, fixedly connected on one side to the railcar body-side end section 103 of the coupling rod 102 and on the other to the base plate 110. Each reset arm 140, 140' comprises a leg spring consisting of a coil spring 141, 141' and lever-like limbs 142, 143, 142', 143'.

The coil springs 141, 141' of the leg springs are designed and disposed such that their axes are subject to torsion upon a rotation of the coupling rod 102. The railcar body-side end section as well as the opposite end section of the coil spring each give way to the lever-like limbs 142, 143, 142', 143', whereby the railcar body-side limbs 142, 143 are each fixedly connected to the base plate 110 of the linkage 101 by means of a bolt 150. The opposite limbs 142', 143' of the leg springs are each fixedly connected to the railcar body-side end section 103 of the coupling rod 102 by means of a connecting arm 144, 144'.

Upon the coupling rod 102 being deflected horizontally or vertically relative the base plate 110, the axes of the two coil springs 141, 141' of the leg springs are subject to torsion such that a return force acts on the coupling rod 102 and enables the coupling rod 102 to be returned to its initial position. The dashed lines in FIG. 1*b* indicate the coupling rod 102 pivoted in the horizontal plane relative the base plate 110.

The structure consisting of the two leg springs not only enables the resetting of a coupling rod 102 pivoted horizontally and/or vertically relative the base plate 110 but also concurrently serves as an anti-rotation means as the railcar body-side end section 103 of the coupling rod 102 is fixedly connected to said base plate 110 by means of said leg springs.

As a consequence of the at times extreme forces acting on the linkage 101, however, the design of such a structure to effect resetting and anti-rotation is complex because it has to be accordingly designed to met the expected demands. In particular, the horizontal and vertical deflection angle of the coupling rod achievable with the conventional linkage is at times limited to a relatively low range by the provision of the leg springs as the coupling rod return.

Thus, the present invention is based on the task of further developing a linkage of the type cited at the outset and addresses realizing a centering and in particular a resetting of a coupling rod rotated during operation in a simple yet effective manner without requiring any additional components to do so. In particular, the linkage as a whole is to have a simpler structure in comparison to the known prior art solution as exemplarily outlined in the preceding.

This task is solved in accordance with the invention by a linkage of the type cited at the outset in that the at least one front spring element and/or the at least one rear spring element engage with the base plate such that the rotational forces transmitted from the coupling rod to the base plate will be conducted at a right angle without slip. Accordingly, the inventive solution requires a form-fit interlocking of at least one spring element of the drawgear and the base plate so that the rotational forces transmitted from the coupling rod upon its rotation are conducted at a right angle to the base plate via the at least one spring element in form-fit engagement with said base plate. Due to the normal forces occurring at the junctures between the at least one spring element and the base plate, no transverse forces arise such that no slip can occur.

The inventive solution exhibits a great number of substantial advantages over the known prior art linkage as described above as an example. Because the at least one front and the at least one rear spring element are arranged between the base plate and the associated spring plate, the spring elements brace against the respective end faces of the base plate such that the spring elements not only serve to dampen the tractive and impact forces transmitted from the coupling rod but in addition also take on the function of vertically and horizontally supporting the coupling rod at the base plate. The inventive solution thus also enables the spring elements to absorb at least some of the force transmitted by a horizontal or vertical pivoting of the coupling rod relative to the base plate. After the load is relieved, the spring elements thereby ensure the coupling rod returns to its initial position.

Additionally to the horizontal and vertical resetting, the spring elements utilized in the inventive solution are however also particularly accorded the function of ensuring the anti-rotation or resetting of a rotated coupling rod. When the coupling rod is rotated relative to the base plate, the interlocking of the front and/or rear spring element and the base plate effects the conducting of the torsional force to the base plate at a right angle. This thus does away with the need for an additional component to block rotation, which in turn reduces the complexity of the linkage structure.

The inventive solution thus constitutes a simple variant of a linkage, whereby the basic structure of the inventive linkage is similar to the basic structure of a known prior art linkage making use of elastomer spring elements in the form of hollow rubber springs. Thus the inventive solution can also be employed in conventional coupling and joints to interconnect railcars and/or entire trains using e.g. an automatic coupling or a close coupling.

Due to their design, the spring elements used in conventional linkages usually exhibit circular cross-sections and primarily assume only the function of damping the tractive and impact forces transmitted from the linkage. As with conventional linkages, the basic structure of the inventive linkage also consists of a bolted coupling rod with spring plates, a front and rear elastomer spring element and a base plate. The invention provides for at least one spring element to be in a form-fit engagement with the base plate so as to enable a no-slip transfer of the rotational forces acting on the coupling rod to the base plate, and in particular the return of a coupling rod which has been rotated. Since the anti-rotation protection is realized by means of at least one of the spring elements, the rotational forces being transmitted to the base plate are also dampened.

In addition to providing anti-rotation protection, the inventive linkage also has the task of transmitting tractive and impact, respectively compressive, forces as occur during operation. To this end, the linkage is configured such that tractive and compressive forces are introduced into the linkage by the coupling rod. The compressive forces are thereafter transmitted to the base plate via the front spring plate and the adjacent spring element. Tractive forces are conducted to the base plate via the rear spring plate and the rear spring element. The base plate is fixedly connected, bolted in particular, to the railcar body undercarriage so that force can flow to the undercarriage via the base plate.

In particular because the invention provides for the spring elements being supported on the base plate in the rotational direction, the spring elements are loaded virtually uniformly, even when the coupling rod transfers relatively high rotational forces. The inventive arrangement of the spring elements relative the base plate thus in particular also effectively prevents the premature wearing of the spring elements.

Advantageous further developments of the invention are set forth in the subclaims.

The form-fit interlocking of the at least one spring element and the base plate proposed by the inventive solution can be realized for example by selecting a gearwheel-like interlocking for the at least one spring element and the base plate. For example, it is conceivable to provide grooves or notched sections around the periphery of the at least one front spring element, whereby correspondingly complementary protruding sections are configured on the front end face of the base plate facing the front spring element. The protruding sections configured on the front end face of the base plate create a form-fit engagement with at least some of the grooves or notched sections configured around the periphery of the front spring element. It is hereby preferable for the protruding sections configured on the front end face of the base plate to exhibit a correspondingly complementary configured form, at least in the contact area with the grooves configured around the periphery of the front spring element.

Alternatively or additionally hereto, it is further conceivable for the at least one rear spring element to exhibit corresponding grooves or notched sections around its periphery, wherein the base plate exhibits protruding sections on its end face facing the at least one rear spring element which engage in form-fit manner with at least some of the grooves or notched sections configured around the periphery of the rear spring element.

It is accordingly provided in a preferred realization of the inventive solution for at least some of the grooves or notched sections configured around the periphery of a spring element to engage like a gearwheel in the protruding sections configured on the end face of the base plate facing the spring element. This ensures in a simple to realize yet effective manner that the rotational forces transferred from the coupling rod to the spring elements of the drawgear will be further conducted at a right angle to the base plate via the protruding sections without slip.

In order to also achieve that the rotational forces acting on the coupling rod will be effectively transmitted without slip from the spring plates fixedly connected to the railcar body-side end section of the coupling rod to the spring elements, one preferred embodiment of the inventive solution provides for the front spring plate to exhibit such protruding sections protruding toward the base plate which enter into a form-fit engagement with at least some of the grooves or notched sections configured around the periphery of the front spring element. Alternatively or additionally hereto, it is further conceivable for also the rear spring plate to exhibit such protruding sections protruding toward the base plate which create a form-fit engagement with at least some of the grooves or notched sections configured around the periphery of the rear spring element.

Thus, this preferred further development of the inventive linkage proposes a form-fit interlocking of the spring plate and the spring elements in order to thereby transmit the rotational forces acting on the coupling rod without slip to the spring elements. Since—as indicated above—at least one spring element is likewise in a form-fit engagement with the base plate, the inventive solution enables effective anti-rotation, a rotational resetting respectively of the coupling rod without requiring additional components to do so.

In order to have torque be conducted from the railcar body-side end section of the coupling rod to the spring elements of the drawgear without tension peaks, it is preferred for at least one of the two spring plates to have at least two and preferably four protruding sections protruding toward the base plate, whereby each of these protruding sections engage in form-fit manner with a respective notched sections configured around the periphery of the spring elements provided between the spring plate and the base plate. The protruding sections of the spring plate protruding toward the base plate are to thereby be situated on a common circular line, whereby the inscribed angles between adjacent protruding sections have the same measure.

It is hereby additionally preferred for at least one of the two end faces of the base plate to also comprise a plurality of protruding sections (preferably two and even further preferred four), wherein these protruding sections are likewise situated on a common circular line with the inscribed angles between adjacent protruding sections having the same measure.

The above-described preferred embodiments of the inventive linkage thereby propose providing notched sections or grooves around the periphery of at least one spring element of the drawgear, whereby at least some of these notched sections create a form-fit engagement with correspondingly complementary protruding sections configured on the base plate. As defined above, it is additionally preferred in this regard for at least one of the two spring plates to also have protruding sections protruding toward the base plate which likewise are received in form-fit manner by at least some of the notched sections configured around the periphery of the at least one spring element.

Alternatively to the above-described embodiments of the inventive solution, however, it is principle also conceivable to provide at least one spring element with the corresponding protruding sections. These protruding sections of this at least one spring element are to thereby engage in form-fit manner in the complementary notched sections configured in the end face facing the at least one spring element.

It is thus for example conceivable for the base plate to exhibit notched sections or grooves on its front end face facing the at least one front spring element, whereby the at least one front spring element exhibits protruding sections protruding toward the front plate which are received in form-fit manner by at least some of the notched sections configured in the front end face of the base plate and which create a form-fit engagement with said notched sections.

Alternatively or additionally hereto, it is of course also conceivable for the base plate to exhibit notched sections at its rear end face facing the at least one rear spring element, whereby the at least one rear spring element exhibits protruding sections protruding toward the base plate which are received in at least some of the notched sections configured in the rear end face of the base plate in form-fit manner, creates a form-fit engagement with said notched sections respectively.

Having said that, it is nevertheless further conceivable for the front and/or rear spring plate to exhibit the corresponding notched sections on its end face facing the base plate, wherein the at least one front and/or the at least one rear spring element exhibits protruding sections protruding toward the corresponding spring plate. These protruding sections of the spring element are configured with respect to the notched sections configured on the end faces of the associated spring plate so as to be received by at least some of the notched sections configured on the end face of the spring plate in form-fit manner.

In terms of function, the embodiment of the inventive linkage in which at least one of the spring elements of the drawgear is configured with protruding sections which engage with the notched sections configured complementary thereto in the base plate or spring plate respectively, corresponds to the embodiment in which the form-fit interlocking of the spring element and the base plate, respectively the form-fit interlocking of the spring element and the spring plate, ensues via the grooves configured around the periphery of the spring element on the one hand and the protruding sections of the base plate, spring plate respectively, on the other.

It is in principle preferred for the at least one front spring element and the at least one rear spring element of the drawgear to be pretensioned between the respective spring plates and the base plate in the direction of traction/compression. This allows the sequence of events occurring in the transfer of the tractive and impact forces to be precisely preset and predefined. In particular achievable is that the spring elements provided in the linkage are activated without play.

One preferred realization of the inventive linkage provides for the through-hole provided in the base plate to be configured in terms of the form of its opening cross-section so as to enable in particular a horizontal pivoting of the end section of the coupling rod extending through the through-hole within a definable angular range, in particular an angular range of ±25°, and thus a deflection of the coupling rod about the Z-axis, when the coupling rod is in an articulated connection to a railcar body by means of the linkage. The base plate as well as the through-hole provided therein are preferably configured such that the coupling rod at full deflection lies flat against the correspondingly configured contour of the base plate.

In the present invention, the term "X-axis" refers to the axis extending in the longitudinal (horizontal) direction of the coupling rod, the term "Y-axis" refers to the horizontal axis at a right angle thereto, and the term "Z-axis" refers to the axis extending vertically to the coupling rod in the longitudinal direction.

As indicated above, it is preferred for the respective spring elements to be flush with the base plate, whereby the spring elements are preferably pretensioned between the respective spring plates and the base plate. So doing effects a support and resetting of the coupling rod in the Y and Z direction. The return of the coupling rod with respect to its rotational axis is effected in accordance with the invention by the form-fit interlocking of the at least one spring element and the base plate, whereby—as noted above—this allows the rotational forces transmitted from the coupling rod to be conducted at a right angle to the base plate without slip.

In order to ensure the movement of the coupling rod, the railcar body-side end section of the coupling rod respectively, relative the base plate as necessarily occurring during operation will be as non-wearing as possible, one preferred embodiment of the inventive linkage provides for the railcar body-side end section of the coupling rod to exhibit a circular cross-section, wherein a bearing is further provided in the through-hole of the base plate and is designed to support the end section of the coupling rod running through the through-hole.

The following will make reference to the accompanying figures in describing a preferred embodiment of the present invention in greater detail.

Shown are:

FIG. 1*a*: a partly sectional side view of a known prior art linkage for the articulated connection of a coupling rod to a railcar body;

FIG. 1*b*: a top plan view of the conventional linkage shown in FIG. 1*a;*

Figure 2:
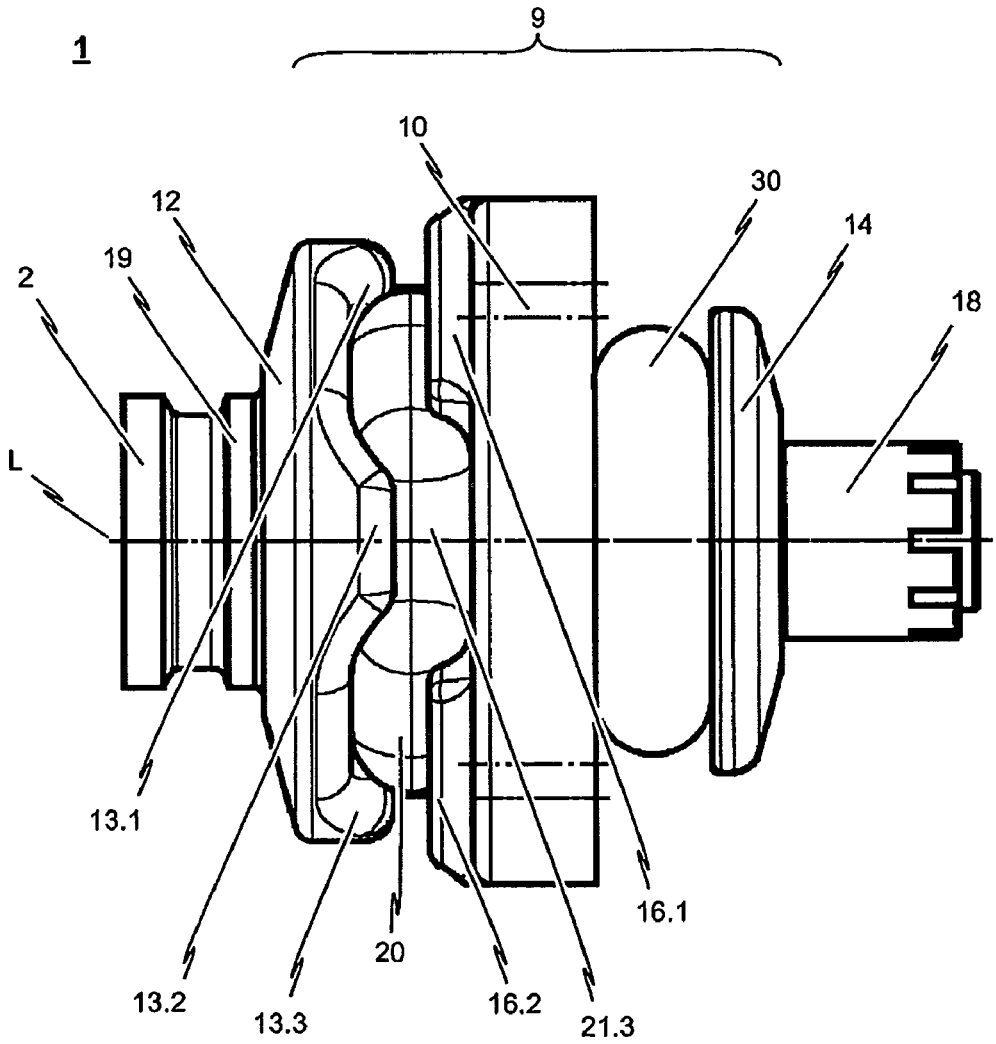
Figure 3:
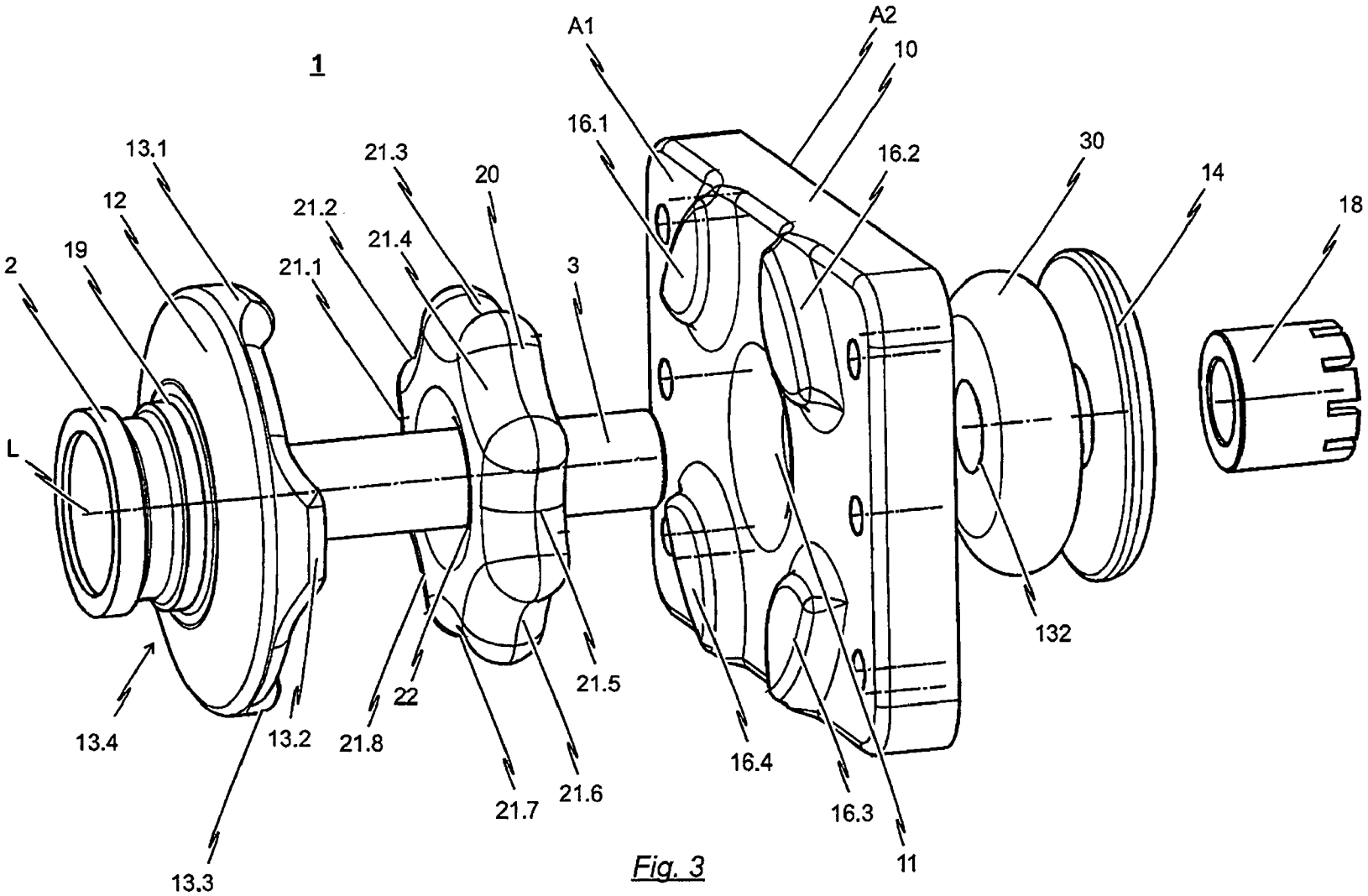
Figure 4:
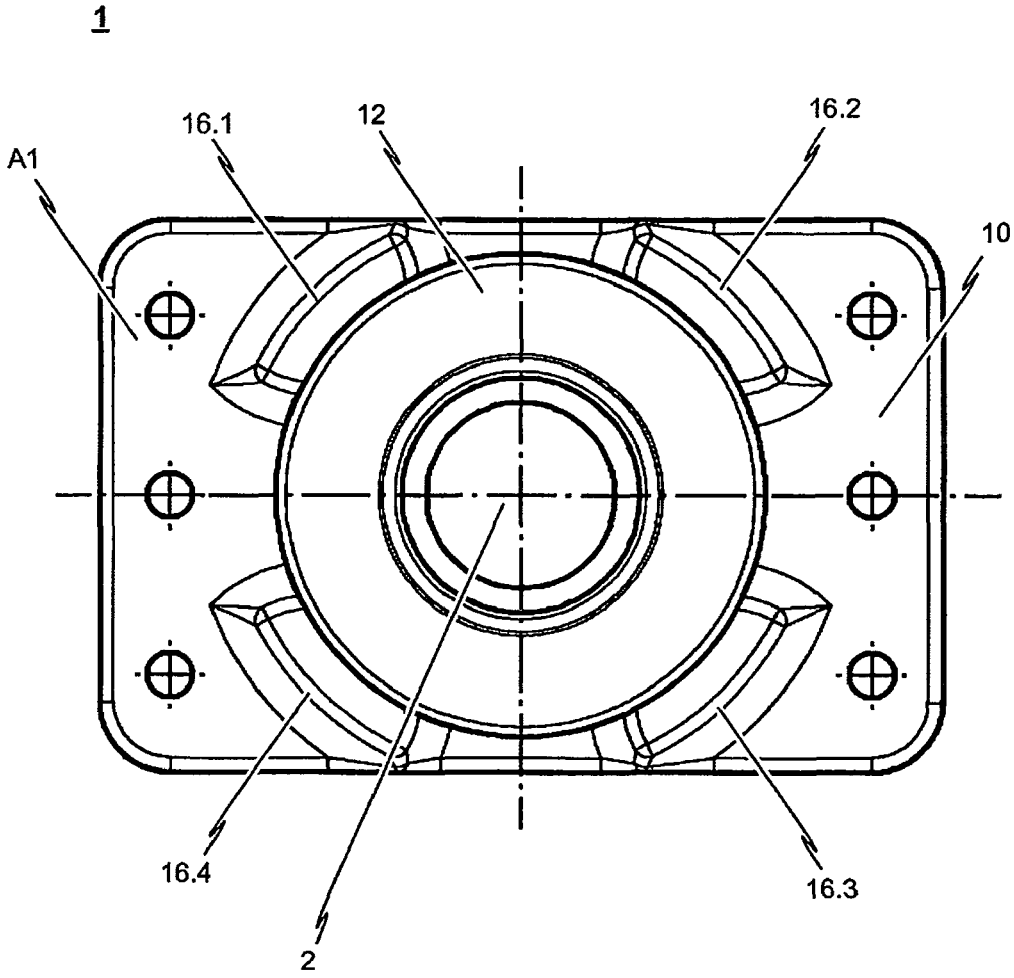

FIG. 2: a side view of an example embodiment of the inventive linkage;

FIG. 3: a perspective exploded view of the example embodiment of the inventive linkage as depicted in FIG. 2; and FIG. 4: a top plan view of coupling rod-side end face of the base plate of the example embodiment of the inventive linkage depicted in FIG. 2.

FIG. 1*a* shows a linkage 101 known from the prior art for the articulated connection of a drawgear 102 to a (not shown) railcar body of a rail vehicle in a partly sectional side view.

FIG. 1*b* shows the conventional linkage 101 of FIG. 1*a* in a top plan view.

The conventional linkage 101 exhibits a base plate 110 fixedly connectable to the railcar body of the rail vehicle which is provided with a through-hole 111 through which extends a railcar body-side end section 103 of the coupling rod 102. The railcar body-side end section 103 of the coupling rod 102 is fixedly connected to the coupling rod 102, the latter not being fully depicted in FIGS. 1*a* and 1*b*. Conceivable hereby is for the railcar body-side end section 103 of the coupling rod 102 to be configured as an integral component of said coupling rod 102. As an alternative, however, it is of course also conceivable for the railcar body-side end section 103 of the coupling rod 102 to be detachably connected to said coupling rod 102.

A drawgear 109 is provided on the railcar body-side end section 103 of the coupling rod 102 which comprises a front spring plate 112 affixed to the coupling rod 102 in front of the base plate 110 in the coupling rod's longitudinal direction L as well as a rear spring plate 114 affixed to the coupling rod 102 behind the base plate 110 in the coupling rod's longitudinal direction L. A front elastomer spring element 120 is further arranged between the base plate 110 and the front spring plate 112 as is a rear elastomer spring element 130 arranged between the base plate 110 and the rear spring plate 114.

The not-shown other end of the coupling rod 102 is connected for example to a likewise not shown coupling head for an automatic central buffer coupling.

The basic structure of the known linkage 101 described above has the rear spring plate 114 affixed to the railcar body-side end of the coupling rod 102 by means of a locknut 118.

The spring elements 120, 130 employed in the conventional linkage 101 are hollow rubber springs having a circular cross-section. In the drawgear 109 of linkage 101, they assume the function of damping the tractive and impact forces occurring in the transfer of force so that the forces are conducted in dampened form from the coupling rod 102 to the (not shown) vehicle undercarriage via the base plate 110.

The embodiment of the known prior art linkage 101 depicted in FIGS. 1*a* and 1*b* is a so-called "donut solution"—one in which the elastomer spring elements 120, 130 resemble a donut, whereby the centrically arranged openings 122, 132 in the respective spring elements 120, 130 exhibit a circular cross-sectional shape. The railcar body-side end section 103 of the coupling rod 102 extends through these openings 122, 132. Nonetheless, the railcar body-side end section 103 of the coupling rod 102 runs through the through-hole 111 disposed in base plate 110.

In order to enable the horizontally and vertically pivotable coupling rod 102 of the conventional linkage 101 depicted as an example in FIGS. 1*a* and 1*b* to be articulated to the (not shown) railcar body so as to be rotationally fixed, the known prior art linkage 101 further comprises anti-rotation means in the form of leg springs 141, 141' which are arranged in a horizontal plane on both sides of the coupling rod 102. In detail, the leg springs 141, 141' are fixedly connected to the base plate 110 via their limb sections 142, 143 facing the base plate 110. The respective opposite limb sections 142', 143' of the leg springs 141, 141' are fixedly connected to the coupling rod 102 by means of a connecting arm 144, 144'. Doing so ensures that the coupling rod 102 cannot rotate relative the base plate 110, or can be returned from a rotated position respectively, while at the same time allowing a horizontal and vertical pivoting of the coupling rod 102 relative the base plate 110.

The problem arising with the known prior art linkage, particularly as regards realizing the anti-rotation protection, has been detailed above in the introductory part of the description and thus will not be reiterated again at this point.

FIG. 2 shows a side view of an exemplary embodiment of the inventive linkage 1. The respective components of linkage 1 according to FIG. 2 can be individually recognized in the perspective exploded view provided by FIG. 3.

In accordance therewith, the exemplary embodiment of the inventive linkage 1 has a basic structure substantially corresponding to the basic structure of a conventional linkage 101 as described for example above by referring to the depictions provided in FIGS. 1*a* and 1*b*. Thus, the inventive solution provides for a base plate 10 which can be connected, particularly bolted, to a (not shown in the figures) railcar body of a rail vehicle. A through-hole 11 runs through the base plate 10 and receives the railcar body-side end section 3 of a coupling rod 2.

A drawgear 9 is further arranged on the railcar body-side end section 3 of a coupling rod 2. This drawgear 9 comprises a front spring plate 12 affixed to the coupling rod 2 in front of the base plate 10 in the coupling rod's longitudinal direction L as well as a rear spring plate 14 affixed to the coupling rod 2 behind the base plate 10 in the coupling rod's longitudinal direction L. The inventive linkage 1 further provides for at least one—and in the depicted exemplary embodiment exactly one—front elastomer spring element 20 arranged between the base plate 10 and the front spring plate 12 as well as at least one—and in the depicted exemplary embodiment of the inventive linkage 1, exactly one—rear elastomer spring element 30 arranged between the base plate 10 and the rear spring plate 14. Each spring element 20, 30 has an opening 22, 32, axially aligned with the through-hole 11 configured in the base plate 10, through which runs the railcar body-side end section 3 of the coupling rod 2.

The two spring plates 12, 14 likewise have an opening configured axially to the centrical through-hole 11 configured in the base plate 10. Thus, the front spring plate 12 can be slid onto the railcar body-side end section 3 of the coupling rod 2 and fixed at an arrester 19 fixedly connected to the coupling rod 2. The front spring element 20, base plate 10, rear spring element 30 and rear spring plate 14 are thereafter slid onto the railcar body-side end section 3 of the coupling rod 2 in succession. A locknut 18 is then slid onto the railcar body-side end of the end section 3 of the coupling rod 2 which fixes the rear spring plate 14 and concurrently pretensions the front and rear spring element 20, 30.

The front spring plate 12 can however also be configured integrally with the railcar body-side end section 3 of the coupling rod 2 in the form of a flange-like projection. Alternatively hereto, it is however of course also conceivable for the front spring plate 12—similar to the rear spring plate 14—to be slid onto the railcar body-side end section 3 of the coupling rod 2 as a separate component and correspondingly fixed at the appropriate position.

The railcar body-side end section 3 of the coupling rod 2 lies flush against the respective spring elements 20, 30 in the openings 22, 32 configured in the front spring element 20 and rear spring element 30. To this end, at least the railcar body-side end section 3 of the coupling rod 2 exhibits a circular cross-sectional geometry having a cross-section which is at least the same size and preferably somewhat larger than the diameter of the openings 22, 32 provided centrically in the two spring elements 20, 30.

In contrast to the basic structure used for a conventional linkage, the exemplary embodiment of the inventive linkage 1 provides for the front spring element 20 and/or the rear spring element 30 (only the front spring element 20 in the example embodiment of linkage 1 depicted in the figures) to engage with the base plate 10 such that rotational forces transmitted from the coupling rod 2 can be conducted at a right angle to the base plate 10 without slip.

Because at least one spring element 20, 30 and the base plate 10 interlock according to the invention, anti-rotation locking is realized in a simple yet effective manner, whereby it is no longer necessary to provide supports, etc. for the rotational locking or resetting of a rotated coupling rod 2 to its initial position, e.g. in the form of a complicated leg spring arrangement.

The following will make reference to the depictions provided in FIGS. 2 and 3 in describing in greater detail how the interlocking of the at least one spring element 20, 30 and the base plate 10 can be realized in the exemplary embodiment of the inventive linkage 1.

As can particularly be seen from the perspective exploded view of FIG. 3, the front spring element 20 in the exemplary embodiment of linkage 1 as depicted exhibits grooves or notched sections 21.1 to 21.8 around its periphery. The depicted embodiment provides a total of eight individual notched sections 21.1 to 21.8 uniformly spaced over the periphery of the front spring element 20. In the exemplary embodiment of the inventive linkage 1 depicted in the drawings, each notched section 21.1 to 21.8 configured around the periphery of the front spring element 20 is of identical configuration. This is of course, however, not imperative.

On the other hand, the exemplary linkage 1 depicted in the drawings provides for the base plate 10 to exhibit protruding sections 16.1 to 16.4 on its front end face A1 facing the front spring element 20. Specifically, a total of four protruding sections 16.1 to 16.4 are hereby employed.

Noted particularly from the FIG. 4 representation showing a top plan view of the front end face A1 of the exemplary embodiment of the inventive linkage 1 is that the protruding sections 16.1 to 16.4 of the exemplary embodiment of the linkage 1 are situated on a common circular line, whereby the inscribed angles between adjacent protruding sections have the same measure.

The protruding sections 16.1 to 16.4 are configured such that when the linkage 1 is assembled (cf. FIG. 2), they engage like a gearwheel into the notched sections 21.2, 21.4, 21.6 and 21.8 configured on the periphery of the front spring element 20. Because of the interlocking of the front spring element 20 on the one side with the base plate 10 on the other thus effected, rotational forces transmitted from the coupling rod 2 are conducted at a right angle to the base plate 10 without slip. Since the base plate 10 is fixedly connected to the railcar body when linkage 1 is mounted, the rotational force introduced to the base plate 10 counters a corresponding opposing torque so that the interacting of the front spring element 20 and the base plate 10 provides an anti-rotational locking for the coupling rod 2.

On the other hand, in the exemplary embodiment of linkage 1 as depicted in the figures, the rotational forces acting on the coupling rod 2 are not introduced to the base plate 10 directly, but rather via the front spring element 20. Accordingly, the anti-rotation effected by the interlocking of the front spring element 20 and the end plate 10 is configured so as to allow up to a certain degree of rotation of coupling rod 2 about its rotational axis.

As noted above, a total of four protruding sections 16.1 to 16.4 configured on the front end face A1 of base plate 10 are employed in the exemplary embodiment of inventive linkage 1. The providing of a plurality of protruding sections 16.1 to 16.4 ensures that rotational forces can be transmitted from the coupling rod 2 to the base plate 10 via the front spring element 20 without any tension peaks. This acts to counter premature wearing of the front spring element 20.

It is in principle conceivable for the front spring element 20, its notched sections 21.2, 21.4, 21.6, 21.8 configured along its periphery being in form-fit engagement with the protruding sections 16.1 to 16.4 configured on the front end face A1 of base plate 10, to be tensioned between the front spring plate 12 and the front end face A1 of the base plate 10 such that when coupling rod 2 is rotated, torque will be conducted to the front spring element 20 and thus to the base plate 10 engaged with the front spring element 20 without slip. Preferable for the transmission of torque from the coupling rod 2 to the front spring element 20, however, is for also the front spring plate 12 and the front spring element 20 to be in form-fit engagement.

As can especially be seen from the FIG. 3 depiction, it is hereby conceivable for the front spring plate 12 to exhibit protruding sections 13.1 to 13.4 protruding toward the base plate 10, which in the assembled state of linkage 1 (cf. FIG. 2) create a form-fit engagement with the notched sections 21.1, 21.3, 21.5, 21.7 configured on the periphery of the front spring element 20 in which the protruding sections 16.1 to 16.4 configured on the front end face A1 of base plate 10 are not received.

A design is therefore accordingly selected in which at least one spring element 20, 30—only the front spring element 20 in the exemplary embodiment of the inventive linkage 1 depicted in the drawings—meshes with both the base plate 10 as well as with the associated spring plate 12, 14 similar to a gearwheel so as to thereby enable a transmission of torque from the coupling rod 2 to the base plate 1 and vice-versa without slip. The elastic nature of the spring elements 20, 30 employed in the inventive linkage 1 thus realizes anti-rotation for or a return of the coupling rod without additional components.

In the exemplary embodiment of the inventive linkage 1 described above, there is only a form-fit interlocking of the front spring element 20 and the base plate 10, the front spring plate 12 respectively. Alternatively or additionally hereto, however, it is of course also conceivable for the rear spring element 30 as well as the rear end face A2 of the base plate 10 facing the rear spring element 30 to be correspondingly configured so as to enable a form-fit interlocking of these two components. It is likewise conceivable to configure the rear spring plate 14 such that it creates a form-fit engagement with the rear spring element 30.

For example, the rear spring element 30 can thus exhibit grooves or notched sections along its periphery, whereby the base plate 10 comprises protruding sections protruding toward the rear spring element 30 on its rear end face A2 facing the rear spring element 30 which enter into a form-fit engagement with at least some of the grooves or notched sections configured around the periphery of the rear spring element 30. Having said that, it is nevertheless conceivable for the rear spring plate 14 to be provided with protruding sections protruding toward the base plate 10 which enter into a form-fit engagement with at least some of the grooves or notched sections configured around the periphery of the rear spring element 30.

Since the inventive solution allows configuring at least the railcar body-side end section 3 of the coupling rod 2 with a circular cross-section, an articulated bearing can be received in the through-hole 11 of the base plate 10 in order to support the coupling rod 2 in the through-hole 11 of the base plate 10 and enable movement of the coupling rod 2 relative the base plate 10 with as little material wear as possible.

The invention is not limited to the exemplary embodiment described in conjunction with the figures; a plurality of variants are in fact also feasible.

It is in particular conceivable to realize a form-fit engagement between the front and/or rear spring element 20, 30 and the base plate 10 by configuring protruding sections on said front and/or rear spring element 20, 30 which protrude toward the base plate 10 and which are received in form-fit manner in the notched sections configured correspondingly complementary thereto in the end face A1, A2 facing the spring element 20, 30.

Alternatively or additionally hereto, it is nonetheless also conceivable to realize a form-fit interlocking of the front and/or rear spring element 20, 30 and the associated spring plate 12, 14 by configuring notched sections in the end face of the spring plate 12, 14 facing the spring element 20, 30 into which protruding sections configured on the spring element 20, 30 and extending toward the associated spring plate 12, 14 engage in form-fit manner.

The invention claimed is:

1. A linkage for an articulated connection of a coupling rod to a railcar body, wherein the linkage comprises:

a base plate connectable to the railcar body in which a through-hole is configured through which a railcar body-side end section of the coupling rod extends; and a drawgear arranged on the railcar body-side end section of the coupling rod and having a front spring plate affixed to the coupling rod in front of the base plate in a longitudinal direction (L) of the coupling rod, and a rear spring plate affixed to the coupling rod behind the base plate in the longitudinal direction (L) of the coupling rock;

wherein the drawgear further comprises at least one front spring element made from an elastic material arranged between the base plate and the front spring plate and at least one rear spring element made from an elastic material arranged between the base plate and the rear spring plate;

wherein the at least one front spring element and/or the at least one rear spring element engage with the base plate such that the rotational forces transmitted from the coupling rod to the base plate will be conducted at a right angle without slim; and wherein the at least one front spring element exhibits grooves along its periphery, and wherein the base plate exhibits protruding section on its front end face facing the at least one front spring element which create a form-fit engagement with at least some of the grooves configured around the periphery of the at least one front spring element.

2. The linkage according to claim 1, wherein the front spring plate exhibits protruding sections protruding toward the base plate which create a form-fit engagement with at least some of the grooves configured around the periphery of the at least one front spring element.

3. The linkage according to claim 1, wherein at least as many grooves are configured on the periphery of the at least one front spring element as protruding sections provided on the front end face of the base plate facing the at least one front spring element.

4. The linkage according to claim 1, wherein the at least one rear spring element exhibits grooves along its periphery, and wherein the base plate exhibits protruding sections on its rear end face facing the at least one rear spring element which create a form-fit engagement with at least some of the grooves configured around the periphery of the at least one rear spring element.

5. The linkage according to claim 4, wherein the rear spring plate exhibits protruding sections protruding toward the base plate which create a form-fit engagement with at least some of the grooves configured around the periphery of the at least one rear spring element.

6. The linkage according to claim 4, wherein at least as many grooves are configured on the periphery of the at least one rear spring element as protruding sections provided on the rear end face of the base plate facing the at least one rear spring element.

7. The linkage according to claim 1, wherein the base plate has one of two or four protruding sections on at least one of its two end faces, wherein the protruding sections are situated on a common circular line and the inscribed angles between adjacent protruding sections have the same measure.

8. The linkage according to claim 1, wherein the base plate has notched sections on its front end face facing the at least one front spring element, and wherein the least one front spring element exhibits protruding sections protruding toward the end plate which create a form-fit engagement with at least some of the notched sections configured in the front end face of the base plate.

9. The linkage according to claim 8, wherein the front spring plate exhibits notched sections on its end face facing the at least one front spring element, and wherein the at least one front spring element exhibits protruding sections protruding toward the front spring plate which create a form-fit engagement with at least some of the notched sections configured in the end face of the front spring plate.

10. The linkage according to claim 1, wherein the base plate exhibits notched sections on its end face facing the at least one rear spring element, and wherein the at least one rear spring element exhibits protruding sections protruding toward the end plate which create a form-fit engagement with at least some of the notched sections configured in the rear end face of the base plate.

11. The linkage according to claim 10, wherein the rear spring plate exhibits notched sections on its end face facing the at least one rear spring element, and wherein the at least one rear spring element exhibits protruding sections protruding toward the rear spring plate which create a form-fit engagement with at least some of the notched sections configured in the end face of the rear spring plate.

12. The linkage according to claim 1, wherein the at least one front spring element and the at least one rear spring element are pretensioned between the respective spring plates and the base plate in the direction of traction/compression.

13. The linkage according to claim 1, wherein the through-hole provided in the base plate is configured in terms of the form of its opening cross-section so as to enable a horizontal pivoting of the end section of the coupling rod extending through said through-hole within a definable angular range, in particular an angular range of ±25°, and thus a deflection of the coupling rod about the Z-axis, when the coupling rod is in an articulated connection to a railcar body by means of the linkage.

14. The linkage according to claim 1, wherein the at least one front spring element and the at least one rear spring element has a respective opening axially aligned with the through-hole configured in the base plate through which the railcar body-side end section of the coupling rod extends, and wherein the at least one front spring element and the at least one rear spring element are configured so as to be respectively supported vertically and horizontally at the respective end faces of the base plate.

15. The linkage according to claim 1, wherein at least the railcar body-side end section of the coupling rod exhibits a circular cross-section, and wherein a bearing, in particular a rotative bearing, is further provided which is arranged in the through-hole of the base plate and is designed to support the end section of the coupling rod extending through said through-hole.

* * * * *